US012378964B2

(12) United States Patent
Morita et al.

(10) Patent No.: US 12,378,964 B2
(45) Date of Patent: Aug. 5, 2025

(54) GAS COMPRESSOR

(71) Applicant: Hitachi Industrial Equipment Systems Co., Ltd., Tokyo (JP)

(72) Inventors: Kenji Morita, Tokyo (JP); Masahiko Takano, Tokyo (JP); Shigeyuki Yorikane, Tokyo (JP); Yoshitaka Takeuchi, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 263 days.

(21) Appl. No.: 17/279,398

(22) PCT Filed: Sep. 11, 2019

(86) PCT No.: PCT/JP2019/035724
§ 371 (c)(1),
(2) Date: Mar. 24, 2021

(87) PCT Pub. No.: WO2020/066629
PCT Pub. Date: Apr. 2, 2020

(65) Prior Publication Data

US 2021/0388835 A1 Dec. 16, 2021

(30) Foreign Application Priority Data

Sep. 28, 2018 (JP) ..... 2018-183158

(51) Int. Cl.
*F04C 28/28* (2006.01)
*F04C 18/16* (2006.01)
*F04C 28/06* (2006.01)

(52) U.S. Cl.
CPC ..... *F04C 28/28* (2013.01); *F04C 18/16* (2013.01); *F04C 28/06* (2013.01);
(Continued)

(58) Field of Classification Search
CPC ..... F04C 18/16; F04C 28/06; F04C 28/28; F04C 2270/19; F04C 2270/78; F04C 2270/90
See application file for complete search history.

(56) References Cited

U.S. PATENT DOCUMENTS 9,352,553 B1 * 5/2016 Tsuno ..... G03G 15/50
2007/0012052 A1 * 1/2007 Butler ..... F24F 11/65 62/181
(Continued)

FOREIGN PATENT DOCUMENTS

CN 102563819 A 7/2012
CN 207366183 U 5/2018
(Continued)

OTHER PUBLICATIONS

Taiwanese-language Office Action issued in Taiwanese Application No. 108134597 dated Mar. 11, 2021 (six (6) pages).
(Continued)

*Primary Examiner* — Connor J Tremarche
(74) *Attorney, Agent, or Firm* — Crowell & Moring LLP

(57) ABSTRACT

A simpler notification is given about identifying causes of abnormalities and indicating dealing methods or countermeasures to deal with the causes of abnormalities.
In a gas compressor including: a compressor body that compresses a gas; a drive source that drives the compressor body; at least one physical sensor that is disposed on at least one of a compressed-gas pipe or an electric system and detects a physical quantity in driving of the compressor body; a display unit; and a controller that processes the detected result from the physical sensor and causes the display unit to display information according to the processing, the controller stores in advance the associated relation between a preset range with respect to a rate of change of the physical quantity and information about at least one of a
(Continued)

cause of a change in the physical quantity and a dealing method of dealing the cause, calculates a rate of change of the physical quantity on the basis of the detected result from the physical sensor, and causes the display unit to display information about at least one of the cause corresponding to the preset range and the dealing method of dealing with the cause when the calculated rate of change of the physical quantity is determined as falling in the preset range.

5 Claims, 6 Drawing Sheets

(52) U.S. Cl.
CPC ..... *F04C 2270/19* (2013.01); *F04C 2270/78* (2013.01); *F04C 2270/90* (2013.01)

(56) References Cited

U.S. PATENT DOCUMENTS

2012/0144852 A1* 6/2012 Wakuta ..... F25B 49/005 62/157
2013/0093829 A1* 4/2013 Rosenblatt ..... H04N 7/18 434/365
2015/0075373 A1* 3/2015 Miller ..... B01D 46/446 96/400
2015/0292762 A1* 10/2015 Clanin ..... G05B 15/02 700/276
2017/0008775 A1* 1/2017 Finke ..... C02F 1/008
2018/0291911 A1* 10/2018 Ward ..... F04F 5/10
2019/0234638 A1* 8/2019 Song ..... F24F 11/62
2019/0331377 A1* 10/2019 Matsuda ..... F25B 5/02

FOREIGN PATENT DOCUMENTS

JP 2001-12379 A 1/2001
JP 2001-133099 A 5/2001
JP 2003-228413 A 8/2003
JP 2006-46955 A 2/2008
WO WO-2016126328 A1 * 8/2016

OTHER PUBLICATIONS

International Search Report (PCT/ISA/210) issued in PCT Application No. PCT/JP2019/035724 dated Nov. 5, 2019 with English translation (three (3) pages).
Japanese-language Written Opinion (PCT/ISA/237) issued in PCT Application No. PCT/JP2019/035724 dated Nov. 5, 2019 (four (4) pages).
Chinese-language Office Action issued in Chinese Application No. 201980062736.2 dated Apr. 8, 2022 (seven (7) pages).
International Preliminary Report on Patentability (PCT/IB/338 & PCT/IB/373) issued in PCT Application No. PCT/JP2019/035724 dated Apr. 8, 2021, including English translation (Japanese-language Written Opinion (PCT/ISA/237) filed on Mar. 24, 2021) (nine (9) pages).

* cited by examiner

FIG. 4

| RANGES | PRESUMED CAUSES | ANNOUNCED CONTENTS (DEALING METHODS) |
|---|---|---|
| $S1 \leq S$ | COMPRESSOR BODY OPERATION FAILURE | MANUAL ROTATION OF COMPRESSOR BODY |
| $S2 \leq S < S1$ | LUBRICATING OIL SHORTAGE | CONFIRMATION OF AMOUNT OF LUBRICATING OIL |
| ... | ... | ... |
| $Sn \leq S < S_{n-1}$ | COOLER CLOGGING SUCTION FILTER CLOGGING | COOLER·SUCTION FILTER CLOGGING |

FIG. 5

DISCHARGE TEMPERATURE ABNORMALITY!
CONFIRM THE FOLLOWING ITEMS SUCCESSIVELY

1. MANUAL ROTATION OF COMPRESSOR BODY

2. LUBRICATING OIL SHORTAGE

3. CLOGGING BETWEEN COOLER FINS

4. CLOGGING OF SUCTION FILTER

DISCHARGE TEMPERATURE ABNORMALITY!
CONFIRM THE FOLLOWING ITEMS SUCCESSIVELY

1. MANUAL ROTATION OF COMPRESSOR BODY

2. LUBRICATING OIL SHORTAGE

3. CLOGGING BETWEEN COOLER TUBES

4. CLOGGING OF SUCTION FILTER

GAS COMPRESSOR

TECHNICAL FIELD

The present invention relates to a gas compressor, and more particularly to a gas compressor that issues notification or announcement about abnormalities.

BACKGROUND ART

Gas compressors such as air compressors have discharged-gas temperature sensors and pressure sensors located in various regions as detecting means useful in the event of abnormalities and failures. The gas compressors generally have a function to judge an abnormality or a failure if the output value of each of those sensors exceeds or becomes lower than a preset value.

For example, in the case of a screw air compressor, if the temperature of air discharged therefrom rises to an unexpected temperature, then male and female rotors in a compressor body are thermally expanded, tending to cause seizure due to contact between rotor end faces and casing end faces, with the result that the air compressor may be stuck. To prevent the air compressor from being stuck, the air compressor incorporates a control function to cause a shutdown when the detected value from a discharged-gas temperature sensor exceeds 100° C., for example, thereby preventing an abnormal temperature rise leading to sticking and hence to prevent the air compressor from being stuck beforehand.

In addition to the above function, Patent Document 1, for example, discloses a vacuum pump having a maintenance determining function. The disclosed example has means for storing detected values of physical quantities from sensors attached to various parts of the vacuum pump along a time base and means for activating an alarm about a maintenance timing depending on the magnitudes of rates of change in derivatives of the physical quantities with respect to time. Since the disclosed example also includes display means for visually displaying time-depending changes in the physical quantities and the content of the alarm, it is possible to judge a location where maintenance is needed from the displayed content.

PRIOR ART DOCUMENT

Patent Document

Patent Document 1: JP-2001-12379-A

SUMMARY OF THE INVENTION

Problems to be Solved by the Invention

According to Patent Document 1, in a vacuum pump, it is possible to display an appropriate maintenance timing and time-depending changes in physical quantities on the basis of physical quantity changing times at various parts. However, nothing is disclosed about a function for predicting and displaying which location in the components of the vacuum pump has caused an abnormality. Therefore, knowledge about devices is required to identify causes of abnormalities. Furthermore, since devices produced by different manufacturers tend to have parts of different specifications even if the devices are of the same type, it is difficult to identify causes of abnormalities. There have been demands for a technology for giving a simpler notification about identifying causes of abnormalities and making dealing methods or countermeasures to deal with the causes of abnormalities.

Means for Solving the Problems

In order to solve the above problems, the arrangements described in the claims are applied. Specifically, a gas compressor includes a compressor body that compresses gas, a drive source that drives the compressor body, at least one physical sensor that is disposed on at least one of a compressed-gas pipe and an electric system and detects a physical quantity in driving of the compressor body, a display unit, and a controller that is configured to process the detected result from the physical sensor and cause the display unit to display information according to the processing. In the gas compressor, the controller is configured to store in advance associated relation between a preset range with respect to a rate of change of the physical quantity and information about at least one of a cause of a change in the physical quantity and a dealing method of dealing the cause, calculate a rate of change of the physical quantity on the basis of the detected result from the physical sensor, and cause the display unit to display information about at least one of the cause corresponding to the preset range and the dealing method of dealing with the cause when the calculated rate of change of the physical quantity is determined as falling in the preset range.

Advantages of the Invention

According to the present invention, it is possible to notify the user, and the like of abnormalities of temperatures and pressures in various parts, predicted causes of the abnormalities, and so on.

Other tasks, arrangements, and advantages of the present invention will become apparent from the description given below.

BRIEF DESCRIPTION OF THE DRAWINGS

FIG. 4 is a schematic diagram illustrating an example of a relation among temperature gradient values S, predicted causes, and dealing methods according to the present embodiment.

FIG. 5 is a schematic diagram illustrating an example of notification contents displayed on a display unit according to the present embodiment.

MODES FOR CARRYING OUT THE INVENTION

First Example

Modes for carrying out the invention will hereinafter be described below with reference to the drawings.

Figure 1:
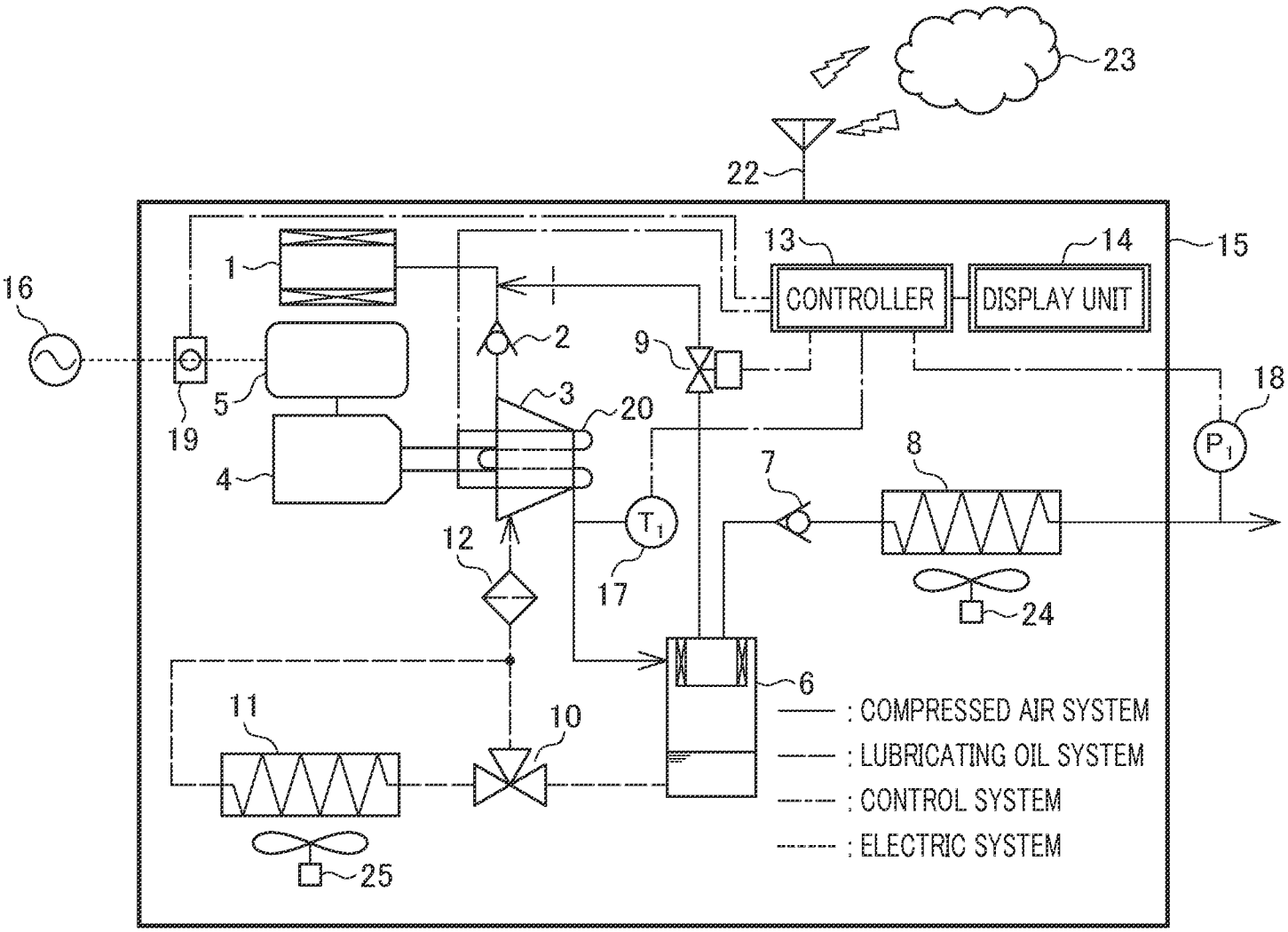
FIG. 1 is a schematic diagram illustrating a configuration of an oil-lubricated screw air compressor according to an embodiment of the present invention.

FIG. 1 schematically illustrates a configuration of an oil-lubricated screw air compressor 15 (hereinafter also referred to simply as "compressor 15" or "unit") according to an embodiment of the present invention. In the compressor 15, when an electric motor 4 drives a compressor body 3, ambient air is filtered by a suction filter 1 to remove dirt therefrom, and then drawn through a suction restriction valve 2 into the compressor body 3. The ambient air drawn into the compressor body 3 has its pressure boosted by the compressor body 3. When the pressure of the ambient air has reached a predetermined pressure, a gas-liquid mixture including compressed air and lubricating oil is discharged from an outlet port of the compressor body 3.

The gas-liquid mixture discharged from the compressor body 3 flows into an oil separating tank 6 as a gas-liquid separator and is separated into the compressed air and the lubricating oil. The compressed air from the oil separating tank 6 is cooled by an air-cooling-type after cooler 8 combined with a cooling fan 24, and then flows to a user facility.

The lubricating oil separated by the oil separating tank 6 is supplied from a temperature adjusting valve 10 through an oil filter 12 to the compressor body 3 when the temperature of the lubricating oil is lower than a threshold value of the temperature adjusting valve 10. When the temperature of the lubricating oil is higher than the threshold value of the temperature adjusting valve 10, the lubricating oil is flowed from the temperature adjusting valve 10 into a side of an oil cooler 11, and cooled with cooling air by a cooling fan 25 so as to bring the lubricating oil temperature into a predetermined temperature range. Then, the lubricating oil is supplied from the oil cooler 11 through the oil filter 12 to the compressor body 3.

Physical quantity detecting means includes a discharged-gas temperature sensor 17 mounted on a compressed gas pipe (specifically, on an outlet port side of the compressor body 3), a discharge line pressure sensor 18 mounted on a compressed gas pipe (specifically, on an outlet port side of the unit), and a current detector 19 included in an electric system (specifically, on a power supply line of the main electric motor 4 or an inverter 5 powered by a power supply 6). A controller 13 performs a processing sequence on output values from these sensors and displays contents according to the processing sequence on a display unit 14.

According to the present example, the processing sequence and the displaying of the contents according to the processing sequence are executed by the controller 13 and the display unit 14. However, as indicated by a dotted-line frame in FIG. 1, the compressor 15 may be connected for communication to a network cloud 23 through wireless or wired communicating means (only a wireless antenna 22 is illustrated in FIG. 1), and a server or the like in the network cloud may execute the processing sequence and issue an instruction of the contents to be displayed according to the processing sequence and cause the contents to be displayed on the display unit 14, or may also cause the contents to be displayed on a management computer in the network cloud 23.

When the compressor has cold climate specifications, it may have a mechanism including an antifreezing device such as a cord heater 20 wrapped around the compressor body 3, and before the compressor starts to operate, the cord heater 20 may be turned on to preheat the compressor body 3. When the compressor 15 starts to operate, if it can be activated without jamming, then the cord heater 20 is turned off, and if it is jammed and cannot be activated, then the cord heater 20 remains energized to continuously preheat the compressor body 3 for a while, after which the compressor is operated again. The cord heater 20 and its control process are dispensable if the compressor 15 has no cold climate specifications.

Figure 6:
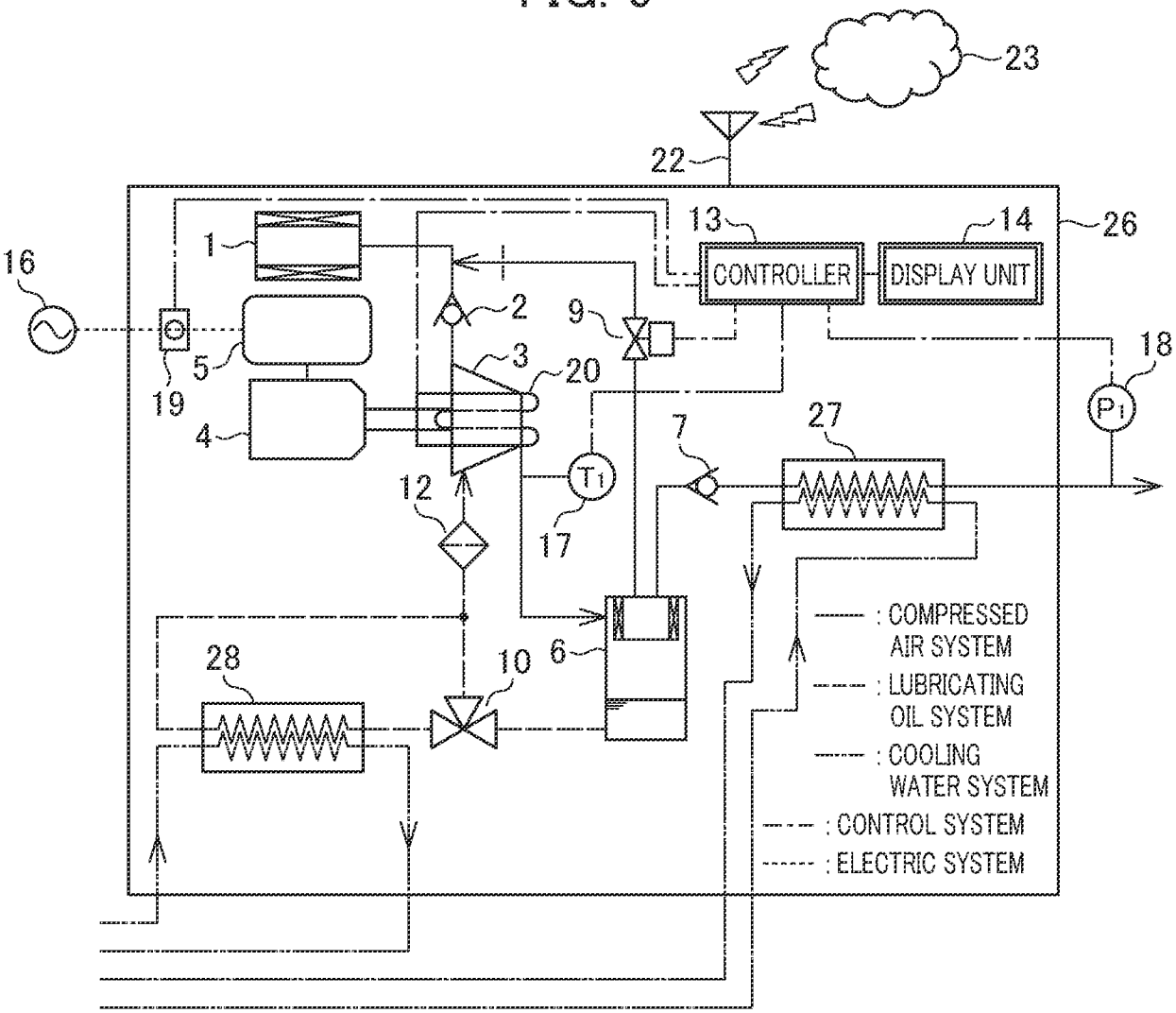
FIG. 6 is a schematic diagram illustrating another example of the configuration of an oil-lubricated screw air compressor according to the embodiment of the present invention.

FIG. 6 schematically illustrates another example of the configuration of an oil-lubricated screw air compressor. The screw air compressor 26 includes a water-cooling-type after cooler 27 and an oil cooler 28 for cooling compressed air and lubricating oil by way of a heat exchange with cooling water, instead of the air-cooling-type after cooler 8 and the oil cooler 11 provided in the compressor 15.

The present example is applicable to either one of the compressors 15 and 26. Subsequently, mainly the compressor 15 will be described below.

A process of abnormality detection and notification according to a feature of the present example will be described below.

Figure 2:
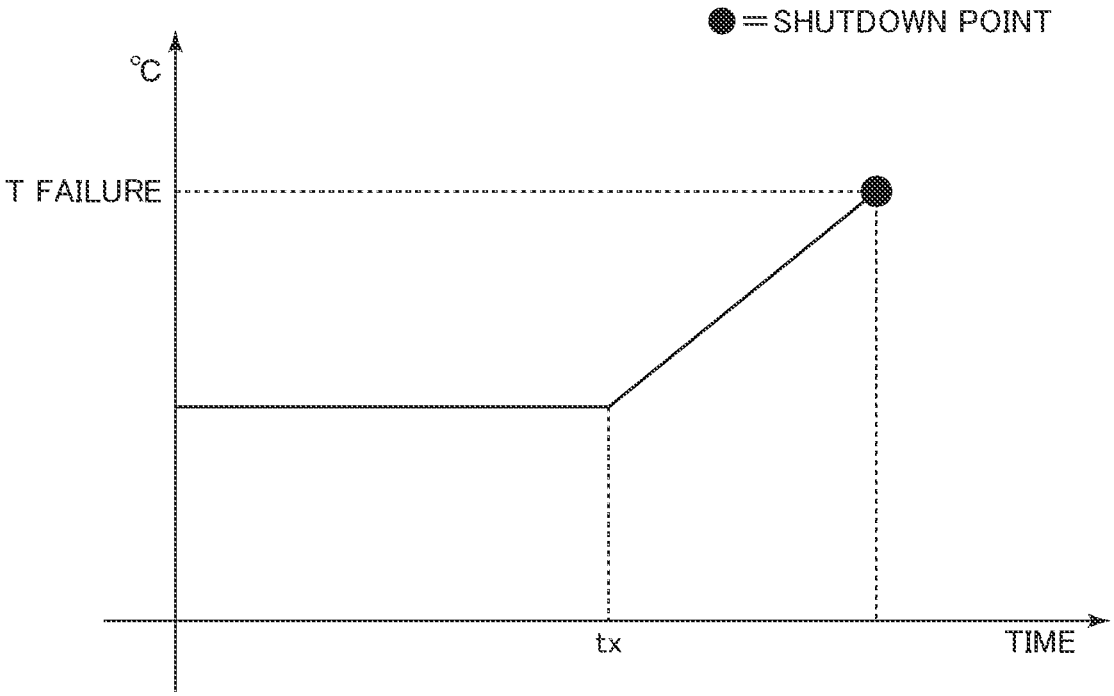
FIG. 2 is a schematic diagram illustrating a relation between a transition of discharged-gas temperature and a failure temperature T according to a comparative example.

FIG. 2 illustrates a time base waveform (during operation under a load) of a transition of discharged-gas temperature of the compressor according to a comparative example. During operation under a load, a stable transition of discharged-gas temperature goes on until time tx at which the discharged-gas temperature rises. When the discharged-gas temperature reaches a failure temperature T, a compressor shutdown occurs. It is known in the art that when the discharged-gas temperature rises, the compressor is shut off and the display unit displays a content such as "discharged-gas temperature abnormality." According to the comparative example, however, though the phenomenon that the temperature reaches T can be displayed, it is not clear which has caused discharged-gas temperature abnormality.

In this respect, according to the present example, not only an abnormality is detected and announced, but also the cause of the abnormality can be dynamically announced.

Figure 3:
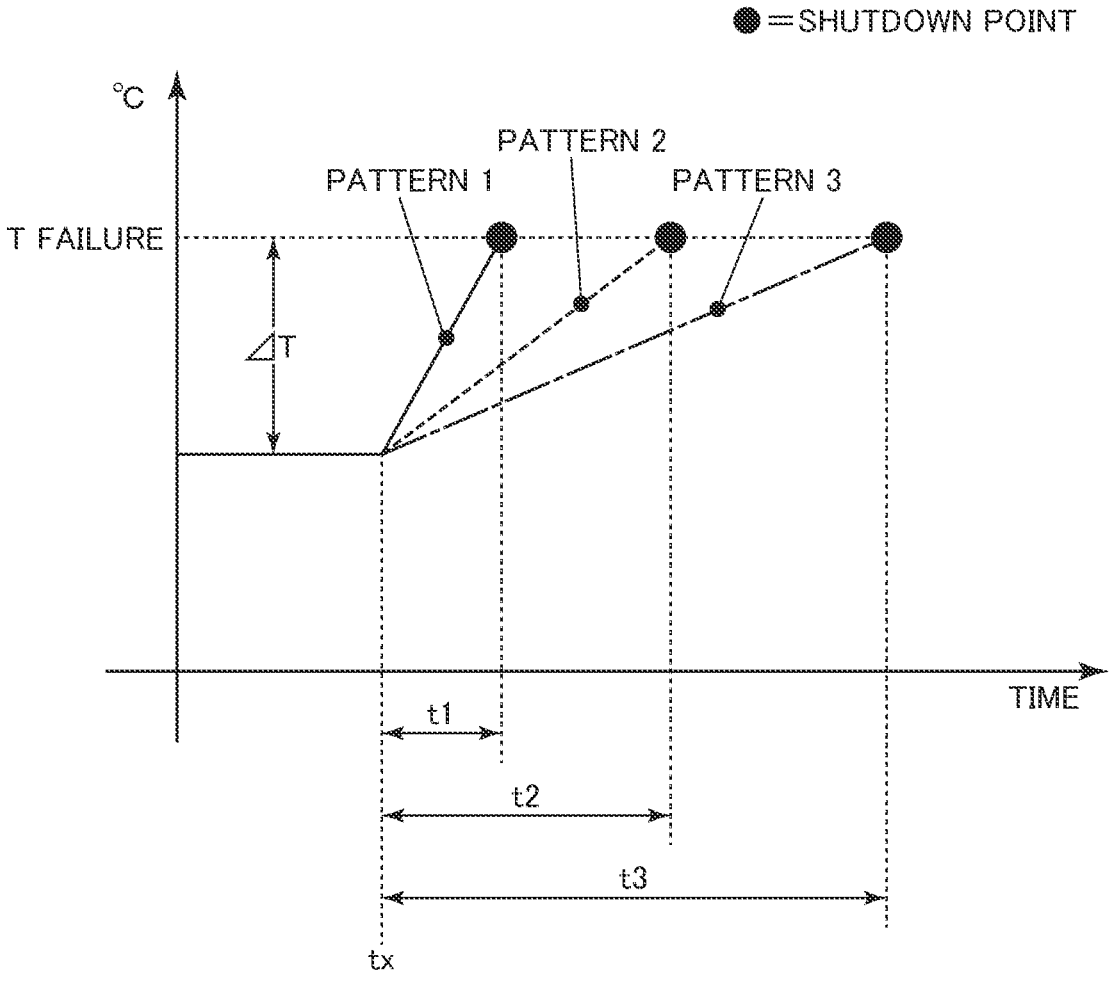
FIG. 3 is a schematic diagram illustrating a relation between a transition of discharged-gas temperature and the failure temperature T according to the present embodiment.

FIG. 3 illustrates a time base waveform (during operation under a load) of a transition of discharged-gas temperature according to the embodiment. During operation under a load, a stable transition of discharged-gas temperature goes on until time tx, as is the case with the transition of discharged-gas temperature illustrated in FIG. 2. FIG. 3 illustrates how the discharged-gas temperature rises after time tx. In FIG. 3, temperature rising patterns from pattern 1 to pattern n (n=natural number) are illustrated. According to these patterns, the discharged-gas temperature rises at different gradients as indicated below.

Pattern 1 (solid line): the discharged-gas temperature reaches a failure value in time t1 at a gradient S1 ($=\Delta T/t_1$);

Pattern 2 (dotted line): the discharged-gas temperature reaches the failure value in time t2 at a gradient S2 ($=\Delta T/t_2$);

Pattern n (dot-and-dash line): the discharged-gas temperature reaches the failure value in time to at a gradient Sn ($=\Delta T/t_n$).

The gradient represents a temperature rise (° C.) per unit time (t).

The differences between the temperature gradients of the patterns depend on the causes of abnormalities. For example, the causes of abnormalities are classified as follows:

When in "S1≤S," the content of a predicted cause is "compressor body operation fault."

When in "S2≤S<S1," the content of a predicted cause is "lubricating oil shortage."

When in "Sn≤S<Sn-1," the content of a predicted cause is "cooler clogging" or "suction filter clogging."

When the discharged-gas temperature rises by ΔT in a relatively short time (t1) from normal operation, as in the pattern 1, the compressor body 3 tends to undergo mechanical defective friction due to screw rotor jamming, bearing breakage, or the like, and the discharged-gas temperature is likely to rise sharply due to frictional heat. When the discharged-gas temperature rises at more gradual gradient, as in the patterns 2 or 3, the compressor body 3 tends to undergo lubricating oil shortage, insufficient cooling, or the like.

According to the present example, the controller 13 stores the phenomenon (at least either predicted causes or dealing methods therefor) of the compressor 15 whose discharged-gas temperature transitions at the gradients (in set ranges) of the patterns 1 through n as information in its memory. The controller 13 calculates a gradient value S (rate of change) of the discharged-gas temperature based on the detected result from the discharged-gas temperature sensor 17, determines which set range the calculated gradient value S of the discharged-gas temperature falls in, and then displays corresponding information on the display unit 14. In other words, the controller 13 associates the range in which the gradient value S is determined with the content of a predicted cause, making it possible to dynamically detect an abnormality and its cause.

Alternatively, an alarm value may be preset at a temperature lower than the failure temperature T for shutdown, and at the time the temperature for the alarm value is reached, a cause of the abnormality may be predicted and announced prior to shutdown.

FIG. 4 illustrates an example of the relation between gradient values S and predicted causes.

When in "S1≤S," the content of a predicted cause is "compressor body operation fault."

When in "S2≤S<S1," the content of a predicted cause is "lubricating oil shortage."

When in "Sn≤S<Sn-1," the content of a predicted cause is "cooler clogging" or "suction filter clogging."

By thus determining ranges of the temperature gradient values S, a predicted cause of an abnormality can preferentially be determined depending on the temperature gradient value S.

FIG. 5 illustrates an example (screen example) of guidance or notification contents displayed on the display unit 14 according to the present example. The notification contents to be displayed are determined on the basis of the information on the relation illustrated in FIG. 4. For example, "MANUAL ROTATION OF COMPRESSOR BODY" is displayed when the gradient value S is S1≤S, and the predicted cause thereof is "COMPRESSION BODY OPERATION FAILURE." At this time, guidance is displayed as user confirmation guidance for prompting the user to confirm rotation of the compressor body either with a tool or manually. In the case of the compressor 26 having the water-cooling cooler, a screen example illustrated in FIG. 7, for example, is displayed as a notification.

According to a feature of the present example, notification contents represent not only countermeasures for predicted causes of an abnormality, but also locations of predicted causes displayed with priorities. Specifically, a cause is predicted as prescribed and a discharged-gas temperature abnormality of the compressor 15 may not necessarily be in conformity with a certain cause. Moreover, a discharged-gas temperature abnormality of the compressor 15 may be caused by a plurality of factors. Consequently, the controller 13 sets a sequence of preset ranges in the order closer to the gradient value S of the discharged-gas temperature, and causes the display unit 14 to display corresponding items of information. By announcing countermeasures as dealing methods for the abnormality in a sequence of higher likelihood from the temperature gradient, the user of the compressor can be guided through the dealing methods that are more efficient with respect to closely correlated causes of the abnormality.

Second Example

According to the first example, a cause of an abnormality is predicted and announced on the basis of a temperature transition until the discharged-gas temperature of the compressor 15 reaches a predetermined temperature such as a failure temperature or the like.

According to a second example, there will be described an example in which the discharged-gas temperature is monitored in real time, and an abnormality notification is given when the gradient at which the temperature rises falls in a preset range in excess of a threshold value. The configuration of the compressor according to the second example is the same as the configuration of the compressor according to the first example, and changes from the first example will mainly be described below.

The discharged-gas temperature of the compressor 15 rises also at the time the compressor 15 switches from operation under no load to operation under a load. Since such a temperature rise should not be detected as an abnormality, the present embodiment is applied after the controller 13 determines that the compressor 15 has operated under a load for a predetermined period of time and the discharged-gas temperature has been stabilized.

Figures 7, 8:
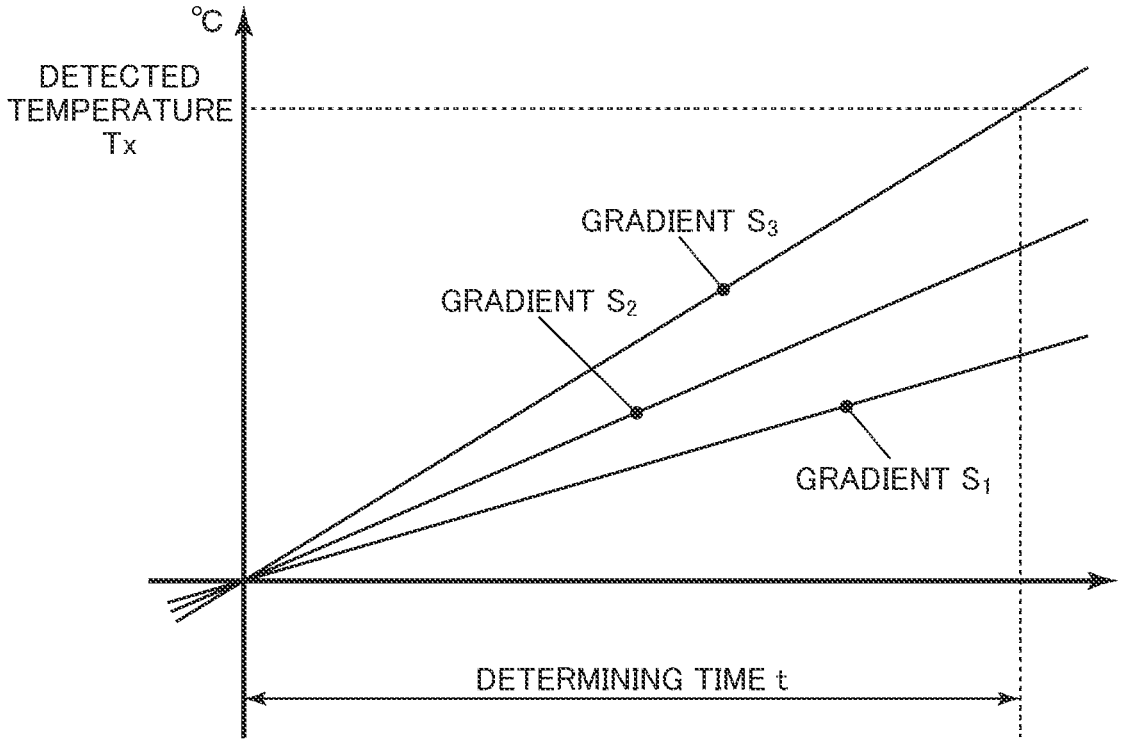
FIG. 7 is a schematic diagram illustrating another example of notification contents displayed on the display unit according to the present embodiment.
FIG. 8 is a schematic diagram illustrating the gradients of transitions of discharged-gas temperatures during a determining time t according to a second example of the present invention.

FIG. 8 schematically illustrates gradient threshold values S1 through S3 for the discharged-gas temperature during a determining time t according to the present example. The controller 13 acquires an output value from the discharged-gas temperature sensor 17 at least during operation under a load, and calculates a gradient value S of the temperature rise in each preset determining time. The controller 13 may alternatively start calculating a gradient value S after it has detected that the discharged-gas temperature has risen to a predetermined temperature or beyond.

Then, the controller 13 compares the calculated gradient value S with the threshold values S1 through S3 that are stored in advance in the memory. If the controller 13 determines that the gradient value S has not exceeded the predetermined threshold values, then the controller 13 continuously operate the compressor and repeatedly calculates a gradient value S in each determining time.

On the other hand, if the controller determines that the gradient value S has exceeded either one of the threshold values S1 through S3, then the controller regards the situation as a detected abnormality and gives an alarm notification depending on the threshold value. The gradient values (S1 through Sn) are stored in association with predicted causes in the memory. Abnormality causes can be estimated and announced on the basis of the associated relation in the same manner as with the first example.

When the controller determines that the gradient value S has exceeded the threshold value S3 that represents a clear abnormality value, the controller may give a notification to that effect and may shift to a degenerate mode of operation without waiting for the discharged-gas temperature to reach the failure temperature T. The degenerate mode of operation includes switching to operation under no load and shutdown. Even after having given a notification, the controller may continue to calculate a gradient value S and determine whether it has exceeded a threshold value in each determining time, so that the controller can give a predicted content notification based on the latest information.

According to the present example, the user can be notified of an abnormality and a predicted cause thereof prior to a shutdown of the compressor 15 upon detection of a failure temperature.

The embodiment, i.e., the modes for carrying out the present invention, have been described above. The present invention is not limited to the embodiment described above, but various changes, modifications, and replacements may be made without departing from the scope of the invention. For example, in the above embodiment, an abnormality and a predicted cause thereof are announced on the basis of only detected values from the discharged-gas temperature sensor 17. However, predicted causes may be displayed on the basis of detected values from a plurality of sensors including, for example, the temperature sensor 17 and the pressure sensor 18, the temperature sensor 17 and the current detector 19, or the like. It is possible to predict a cause of an abnormality with higher accuracy by processing detected information from a plurality of sensors.

In the above embodiment, a discharged-gas temperature rise during operation under a load is detected by way of example. It is general practice for air compressors to operate repeatedly under a load and under no load. Consequently, the temperature rise gradient value S may switch between different values and different ranges depending on the operation under a load or the operation under no load, and a predicted cause of a failure may be displayed depending on the operation under a load or the operation under no load.

In the above embodiment, the oil-lubricated screw air compressors have been described by way of example. However, the present invention is also applicable to any of various compressors including turbo-type and displacement-type compressors. Furthermore, the present invention is not limited to oil-lubricated compressors, but may be applied to compressors in which another liquid such as water instead of oil is supplied to lubricate parts, or may be applied to oil-free compressors. In addition, the present invention is also applicable to a constant-speed compressor in which an inverter is not used to control the electric motor 4.

Though the electric motor 4 is used as a drive source, any of various drive devices including an internal combustion engine, a steam engine, a hydraulic device, a wind power device, and the like may be used to actuate the compressor body.

DESCRIPTION OF REFERENCE CHARACTERS

1: Suction filter
2: Suction restriction valve
3: Compressor body
4: Electric motor
5: Inverter
6: Oil separating tank
8: After cooler
11: Oil cooler
13: Controller
14: Display unit
15: Screw air compressor
16: Power supply
17: Discharged-gas temperature sensor
18: Discharge line pressure sensor
19: Current detector
22: Antenna
23: Cloud
24: Cooling fan

The invention claimed is:

1. A gas compressor comprising: a compressor body that compresses gas; a drive source that drives the compressor body; a discharged-gas temperature sensor that is disposed on a compressed-gas pipe and detects a discharged-gas temperature of the compressor body; a display unit; and a controller that is configured to process the detected result from the discharge-gas temperature sensor and cause the display unit to display information according to the processing, wherein the controller is configured to store in advance a plurality of preset range with respect to a rate of change of the discharged-gas temperature and a plurality of items of information about at least either causes of changes in the discharged-gas temperature or dealing methods of dealing with the causes, according to the plurality of present ranges, calculate a rate of change of the discharged-gas temperature on a basis of the detected result from the discharged-gas temperature sensor, determine which predetermined set range the calculated rate of change of the discharged-gas temperature falls in, wherein the predetermined set range is associated with a predicted cause of an abnormality, set a sequence of the preset ranges in the order closer to the calculated rate of change in the discharged-gas temperature and cause the display unit to display a list of corresponding items of information about at least either corresponding causes or dealing methods of dealing with the causes when the calculated rate of change of the discharged-gas temperature is determined as falling any one of in the preset ranges, and dynamically display the abnormality and the predicted cause thereof.

2. The gas compressor according to claim 1, wherein
the display unit receives information from the controller through a wired or wireless communication link.

3. The gas compressor according to claim 1, wherein
the gas compressor comprises a displacement compressor or turbo compressor and liquid-lubricated or oil-free compressor.

4. The gas compressor according to claim 1, wherein a prompting includes prompting the user to confirm rotation of the compressor body either with a tool or manually.

5. The gas compressor according to claim 1, wherein
the controller is configured to cause the display unit to display user confirmation guidance,
user confirmation guidance includes prompting a user to confirm execution of an instruction.

* * * * *